US010888900B2

(12) United States Patent
Mayer et al.

(10) Patent No.: US 10,888,900 B2
(45) Date of Patent: Jan. 12, 2021

(54) ROCK BOX SPLITTER

(71) Applicant: M-I L.L.C., Houston, TX (US)

(72) Inventors: Marc Mayer, Burlington, KY (US); Robert Lunnemann, Florence, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 16/078,634

(22) PCT Filed: May 2, 2017

(86) PCT No.: PCT/US2017/030478
§ 371 (c)(1),
(2) Date: Aug. 21, 2018

(87) PCT Pub. No.: WO2017/192468
PCT Pub. Date: Nov. 9, 2017

(65) Prior Publication Data

US 2019/0054502 A1 Feb. 21, 2019

Related U.S. Application Data

(60) Provisional application No. 62/331,423, filed on May 3, 2016.

(51) Int. Cl.
*B07B 1/46* (2006.01)
*B07B 13/16* (2006.01)
*B07B 1/38* (2006.01)

(52) U.S. Cl.
CPC ..... *B07B 1/4618* (2013.01); *B07B 1/38* (2013.01); *B07B 13/16* (2013.01); *B07B 2201/04* (2013.01)

(58) Field of Classification Search
CPC .. B07B 1/284; B07B 1/38; B07B 1/46; B07B 1/4618; B07B 13/16; B07B 2201/04
(Continued)

(56) References Cited

U.S. PATENT DOCUMENTS 597,412 A * 1/1898 Hintz, Jr. ..... B01D 29/41 209/362
2,952,362 A * 9/1960 Johnston ..... B03B 5/02 209/480

(Continued)

OTHER PUBLICATIONS

International Preliminary Report on Patentability for the equivalent International Patent Application PCT/US2017/030478 dated Nov. 15, 2018.

(Continued)

*Primary Examiner* — Joseph C Rodriguez
(74) *Attorney, Agent, or Firm* — Jeffrey D. Frantz

(57) ABSTRACT

Described herein are splitters for holding and distributing input material to one or more decks of a gyratory sifter, where the splitter distributes approximately an equal amount of input material to each deck. An exemplary splitter may include a bottom surface, a sidewall, and one or more openings through the sidewall. Each opening may include a plurality of slits, allowing input material to pass therethrough. Where multiple openings are provided through the sidewall, the openings may be evenly spaced and have an equivalent area. The bottom surface may be substantially circular, and the sidewall may extend perpendicularly from the edges of the bottom surface. An exemplary splitter may be able to receive and distribute the input material when a gyratory force acts on the gyratory sifter on which the splitter is installed.

20 Claims, 4 Drawing Sheets

(58) Field of Classification Search
USPC ..... 209/240, 243, 247, 254
See application file for complete search history.

(56) References Cited

U.S. PATENT DOCUMENTS

| | | | | | |
|---|---|---|---|---|---|
| 3,388,797 | A * | 6/1968 | Vifian | B07B 1/284 | 209/241 |
| 3,452,868 | A * | 7/1969 | Miller | B01D 35/20 | 209/254 |
| 3,530,986 | A * | 9/1970 | More | D21D 5/06 | 209/234 |
| 3,680,697 | A * | 8/1972 | Hubach | B07B 1/28 | 209/240 |
| D249,955 | S * | 10/1978 | Vogelsang | D23/261 | |
| 4,940,535 | A * | 7/1990 | Fisher | B01D 33/03 | 209/250 |
| 5,222,605 | A | 6/1993 | Pogue | | |
| 5,230,431 | A | 7/1993 | Andren | | |
| 5,382,370 | A * | 1/1995 | Jones | B01D 33/15 | 210/781 |
| 6,428,693 | B2 * | 8/2002 | Singleton | B01D 29/15 | 210/163 |
| 6,530,482 | B1 * | 3/2003 | Wiseman | B01D 33/0346 | 209/253 |
| 7,225,931 | B2 * | 6/2007 | Glad | B01D 29/15 | 209/23 |
| D749,706 | S * | 2/2016 | Johansen | D23/260 | |
| 9,694,391 | B1 * | 7/2017 | Mayer | B07B 1/284 | |
| 9,718,008 | B2 * | 8/2017 | Peresan | B07B 13/16 | |
| 9,752,399 | B2 * | 9/2017 | Timmerman | E21B 21/063 | |
| 9,945,125 | B2 * | 4/2018 | Huber | E04D 13/0409 | |
| 10,220,414 | B2 * | 3/2019 | Heitfeld | B07B 1/42 | |
| 2007/0095727 | A1 | 5/2007 | Bishop | | |
| 2010/0264243 | A1 | 10/2010 | Blickley et al. | | |
| 2015/0135636 | A1 | 5/2015 | Ayres | | |
| 2017/0320098 | A1 * | 11/2017 | Knorr | B07B 1/284 | |
| 2019/0193117 | A1 * | 6/2019 | Heinz Stahlhofer Bergmann | B07B 1/28 | |

OTHER PUBLICATIONS

International Search Report and Written Opinion for the equivalent International Patent Application PCT/US2017/030478 dated Aug. 4, 2017.

Examination Report for the equivalent Canadian patent application 3,022,695 dated Oct. 10, 2019.

Examination Report issued in Canadian patent application 3,022,695 dated Jun. 10, 2020, 4 pages.

* cited by examiner

ROCK BOX SPLITTER

CROSS-REFERENCE TO RELATED APPLICATION

The present application claims priority to U.S. Application Ser. No. 62/331,423, filed May 3, 2016, which is incorporated herein by reference in its entirety

BACKGROUND

Gyratory equipment, including gyratory sifters, is used as a mechanical screen or sieve. The screening capability of gyratory equipment generally depends on the substantially circular motion and/or oscillation of the equipment. Gyratory equipment can be adapted to screen both wet and dry materials. More particularly, gyratory sifters may be employed to sift many materials, including frac sand, resin coated sand, ceramic proppant, activated carbon, fertilizer, limestone, petroleum coke, plastic pellets, PVC powder, metallic powders, ceramic powders, roofing granules, salt, sugar, grain, and more. Gyratory sifters may be employed in the hydraulic fracturing, oil, construction, mining, food, chemical, materials science, pharmaceutical, and plastics industries and more.

Gyratory equipment may include one or more sets of screens. The screens may be arranged vertically, one on top of the other. Screens may be removable and interchangeable, such that different sets of screens may be used for different applications, and worn or damaged screens may be replaced. Generally speaking, the screens may contain different mesh sizes, where the coarsest (largest mesh size) screen is nearest to the input, and the finest (smallest mesh size) is nearest to the final output. A gyratory sifter may have several outputs depending on the application (e.g., one output for each screen), such that the materials unable to pass through each screen may be separately outputted and thus sorted.

An input or feed mechanism may be located at or near the top of a gyratory sifter, (e.g., above or adjacent to the topmost and coarsest screen). When input material is introduced into the gyratory sifter, gyratory motion and gravity enable particles smaller than the mesh size of the screen to move through the screen to the next screen deck below.

Gyratory equipment may include a system of eccentric weights. For example, a gyratory sifter may include a top weight and a bottom weight. The top weight may be coupled to a motor, causing the top weight to rotate in a plane that is close to the center of the mass of assembly. This may cause vibration and movement of the screens in the horizontal plane, which may cause material input to the screen surface to spread across the screen from the middle to the periphery or outer edges of the screen. Such movement may encourage material too large to pass through the screen to be output and thus removed from the screen surface. A bottom eccentric weight may rotate below the center of mass and create a tilt on the screen surface. The imposition of a tilt on the screen surface may cause vibration in a vertical and tangential plane. Such movement may induce particles smaller than the mesh size to pass through the screen surface at a more rapid pace and may encourage particles only slightly smaller than the mesh size to find the correct alignment for passing through the screen, thus increasing turnover. Horizontal or vertical motion may be amplified through spring assemblies.

SUMMARY

Gyratory sifters and components thereof are described in the present disclosure.

Gyratory sifters may contain decks of screens or only one screen. The number of decks in a gyratory sifter, for example, may range from between one and eight, though it is possible to include more decks if needed for a particular application. There may be between one and four screens per deck, depending on the application. More screens may be added per deck if needed for a particular application. In some examples, each deck may be arranged as an independent system with its own set of screens and discharge. Each deck may include its own input, or one input may be provided with a splitter for evenly distributing input material to each deck. The screens of each deck may be arranged vertically, one on top of the other. The screens may contain different mesh sizes, where the coarsest (largest mesh size) screen is nearest to the input, and the finest (smallest mesh size) is nearest to the discharge. A gyratory sifter (or deck system) may have several discharges depending on the application, (e.g., one output for each screen or deck), such that the materials unable to pass through each screen or deck may be separately output and thus sorted.

Each gyratory sifter may include a single input to feed all the decks. The single input may be provided with one or more splitters to create several inlets, one inlet per deck, where the flow of input material may be distributed to each deck evenly. The gyratory motion of the machine may be employed as the mechanism by which the flow of input material is distributed evenly to the particular inlet for each deck.

A splitter in accordance with the present disclosure may additionally function as a reservoir for accumulating input material to be distributed to the decks of the gyratory sifter. The splitter may include a bottom portion that prevents input material from exiting the bottom of the splitter. The splitter may include various openings (e.g., one per deck), along its sidewall. When the gyratory sifter is in operation, gyratory movement, including horizontal or lateral movement components, may force the input material to be thrown through an opening along the sidewall of the splitter. When the direction of movement changes, the input material may be thrown out of a different area of the sidewall. In operation, the movement of the machine may move in each direction for approximately equal times, thus allowing an approximately equal amount of input material to be thrown from each portion of the sidewall of the splitter and onto the corresponding deck of the gyratory sifter. In this manner, even distribution of input material to each deck may be maintained.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are therefore, not to be considered limiting of its scope. The disclosure will be described with additional specificity and detail through use of the accompanying drawings.

In the drawings.

DETAILED DESCRIPTION

Figure 1:
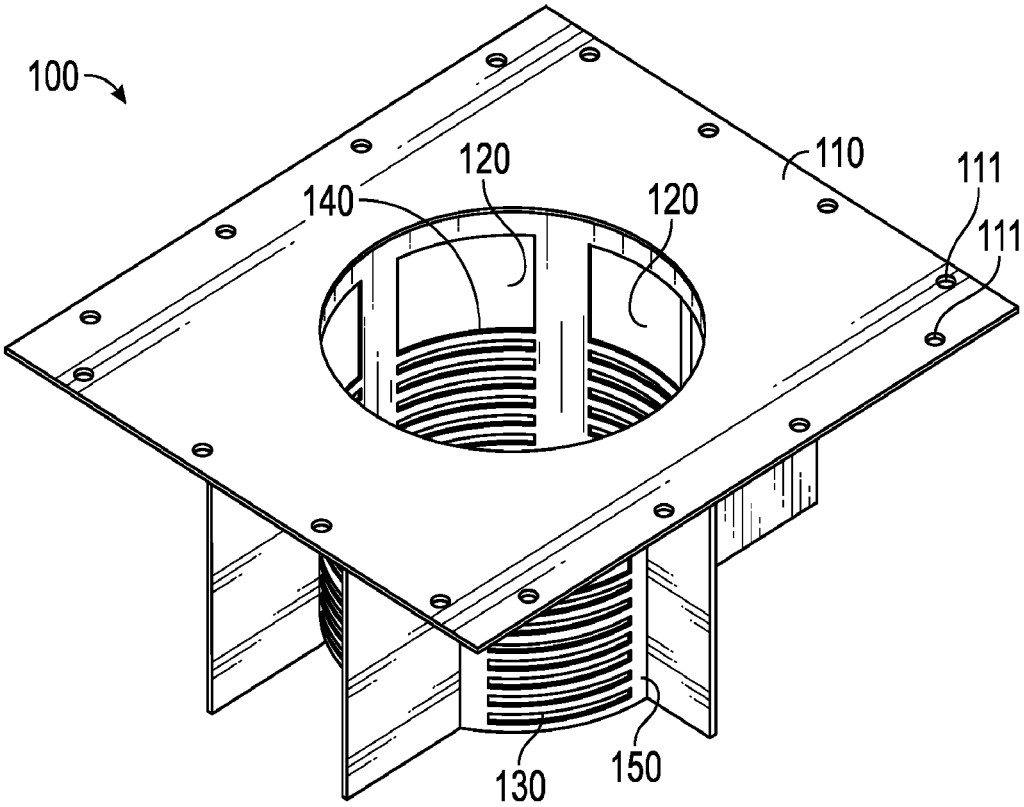
FIG. 1 shows a perspective view of an exemplary splitter containing six openings along the sides of the splitter.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

This disclosure is generally drawn to sifting, separating, and sieve equipment. Some examples of this disclosure are drawn to gyratory equipment, gyratory sifters, and components thereof. Some examples relate to gyratory sifters having multiple decks, where each deck contains multiple screens, and components thereof. Other examples relate to input components for gyratory sifters, particularly to a splitter for splitting or distributing input material, the splitter also functioning as a reservoir for holding input material prior to being distributed by the splitter. This reservoir may function as a rock box to reduce wear on the splitter and the rest of the inlets.

A splitter in accordance with the present disclosure may serve multiple purposes. A splitter may distribute input material to one or more decks of a gyratory sifting machine. A splitter designed may also serve as a reservoir for input material awaiting distribution to the one or more decks of the gyratory sifter. Input material may enter the splitter from a top end of the splitter. The splitter may include a bottom surface. The bottom surface may be solid, preventing input material from exiting through the bottom of the splitter. The bottom surface may enable some input material to collect in the splitter during operation. The splitter may contain one or more sidewalls defining a cylindrical periphery or boundary. The number of sidewalls may depend on the shape of the bottom surface and/or splitter as a whole. For example, a splitter including a circular bottom surface may have one continuous sidewall defining a cylindrical periphery or boundary.

The periphery may include one or more openings therethrough. The number of openings in the periphery may correspond to the number of decks in a gyratory sifter. For example, if a gyratory sifter contains six decks, the sidewall of the splitter may contain six openings therethrough. The openings may be equal in area and may be spaced apart equally from each other.

The openings may include slits (or holes or other voids) that are sufficient in size to allow input material to flow therethrough. Slits may restrict but not prevent input material from flowing through the sidewalls of the splitter. The slits may cause the input material to back up, which produces the rock box function. As input material builds up in the splitter, the gyratory motion throws the product through the slits with an even distribution between the decks. The size of the slits can vary depending on the size of the product that is being screened. In some examples, slits may range from about 0.25 inches in height to about 1 inch in size.

The openings may also include overflow windows, which may allow input material to flow therethrough during a surge of input material being introduced into the splitter. In this manner, the overflow window may prevent a clog of input material or a slowdown in the flow of input material through the splitter.

When a gyratory sifter is in operation, gyratory movement, especially horizontal or lateral movement, may force the input material to be thrown or propelled through openings or slits along the sidewall of the splitter. When the direction of movement changes, the input material may be thrown or propelled through a different opening or slit along the sidewall of the splitter. In this manner, input material may flow through the splitter in a way that distributes input material to different decks of the gyratory sifter. In operation, the movement of the gyratory sifter may move in each direction for approximately equal times, thus allowing an approximately equal amount of input material to be thrown from each side of the splitter and onto the corresponding deck of the gyratory sifter. In this manner, even distribution of input material to each deck may be maintained.

FIG. 1 illustrates an example splitter 100 in accordance with the present disclosure. Splitter 100 may contain a sidewall 150, overflow windows 120, slits 140, and a bottom surface 130. Note that in the view of FIG. 1, the bottom surface 130 can be seen only through slits. Optionally, splitter 100 may include a top surface 110, which may be useful to couple splitter 100 to, for example, an input material feed system or inlet hose. Top surface 110 may be used to couple splitter 100 to another part of a gyratory sifter, such as a frame. To this end, top surface 110 may include a female receptor 111 of a coupling mechanism, which may receive a male end of a coupling mechanism, such as a nut and bolt and/or other mechanisms known to those of skill in the art. Different slit patterns 140 may be used depending on the particular composition of the input material. Slit pattern 140 may be integrated directly into the sidewall 150.

Input material may enter through the top portion of the splitter 100. In the splitter of FIG. 1, this entrance corresponds to the circular hole in top surface 110. Input material may settle on bottom surface 130 and build up so that all or part of the interior of splitter 100 may fill with the input material. When splitter 100 is coupled to a gyratory sifter, the gyratory motion of the gyratory sifter may cause the input material that has built up in the interior of splitter 100 to be ejected through slits 140 and/or overflow windows 120. As the gyratory motion changes during operation of the gyratory sifter, input material may be thrown from different slits 140 and/or overflow windows 120 along the sidewall. During operation, gyratory motion may cause approximately an equal amount of input material to be thrown from each opening. Since each opening of splitter 100 may correspond to a different deck of the gyratory sifter, each deck of the gyratory sifter may receive approximately an equal amount of input material to be sifted. The splitter 100 of FIG. 1 contains six openings (each including slits 120 and an overflow window 140), which could enable splitter 100 of FIG. 1 to be used in a six-deck gyratory sifter. This may be referred to as a 1:6 splitter. One of skill in the art may realize that a splitter with a different number of openings may be used in a gyratory sifter with a different number of decks. For example, a two-opening splitter may split the input material into two decks, a four-opening splitter may split the input material into four decks, and an eight-opening splitter may split the input material into eight decks.

Figure 2:
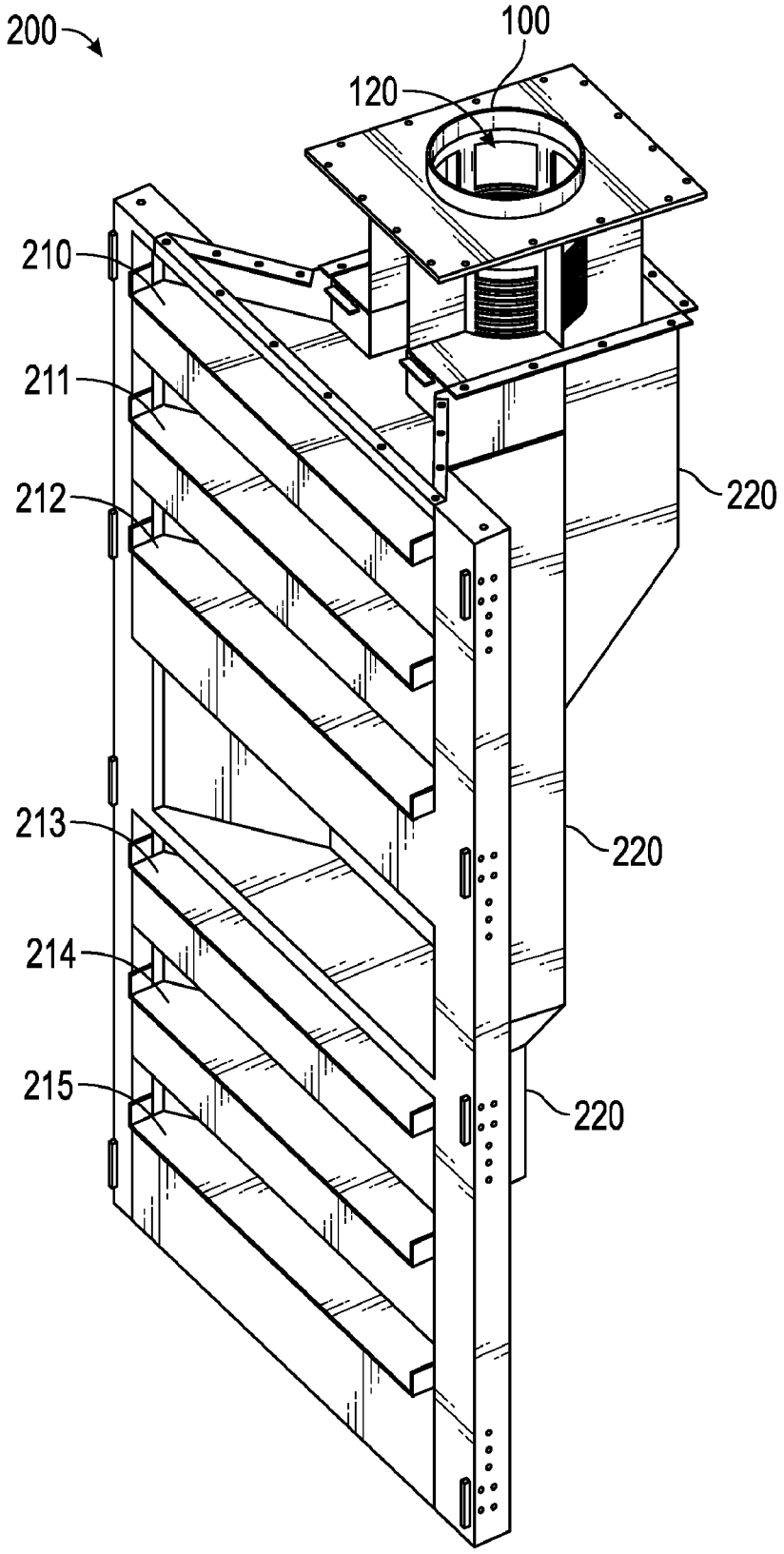
FIG. 2 shows a perspective view of an exemplary six-deck inlet door of a gyratory sifter with an exemplary splitter.

A gyratory sifter may include an inlet door to couple the openings of the splitter 100 to the decks of the gyratory sifter. FIG. 2 illustrates an exemplary inlet door 200 with an exemplary splitter 100 attached thereto. Inlet door 200 may include a plurality of inlets 220 (the exteriors of which are shown in FIG. 2). Each inlet 220 may lead to a different deck 210-215, where each deck may include one or more screens. Each opening (including slits 120) of splitter 100 may be in communication with and correspond to an inlet 220 such that the number of openings in the splitter 100 equals the number of inlets 220 in the inlet door 200, and the number of inlets 220 in inlet door 200 equals the number of decks 210-215 in the gyratory sifter. In some examples, there may not be a separate inlet component leading from the splitter 100 to the top deck 210. Input material may fall directly from the splitter 100 to the top deck 210. Inlets 220 may guide or direct input material thrown from the corresponding openings (through slits 120) in the splitter 100 to the corresponding deck 210-215. The gyratory motion of the gyratory sifter may ensure that approximately an equal amount of input material is guided from splitter 100 to each deck 210-215 via respective inlets 220.

Figure 3:
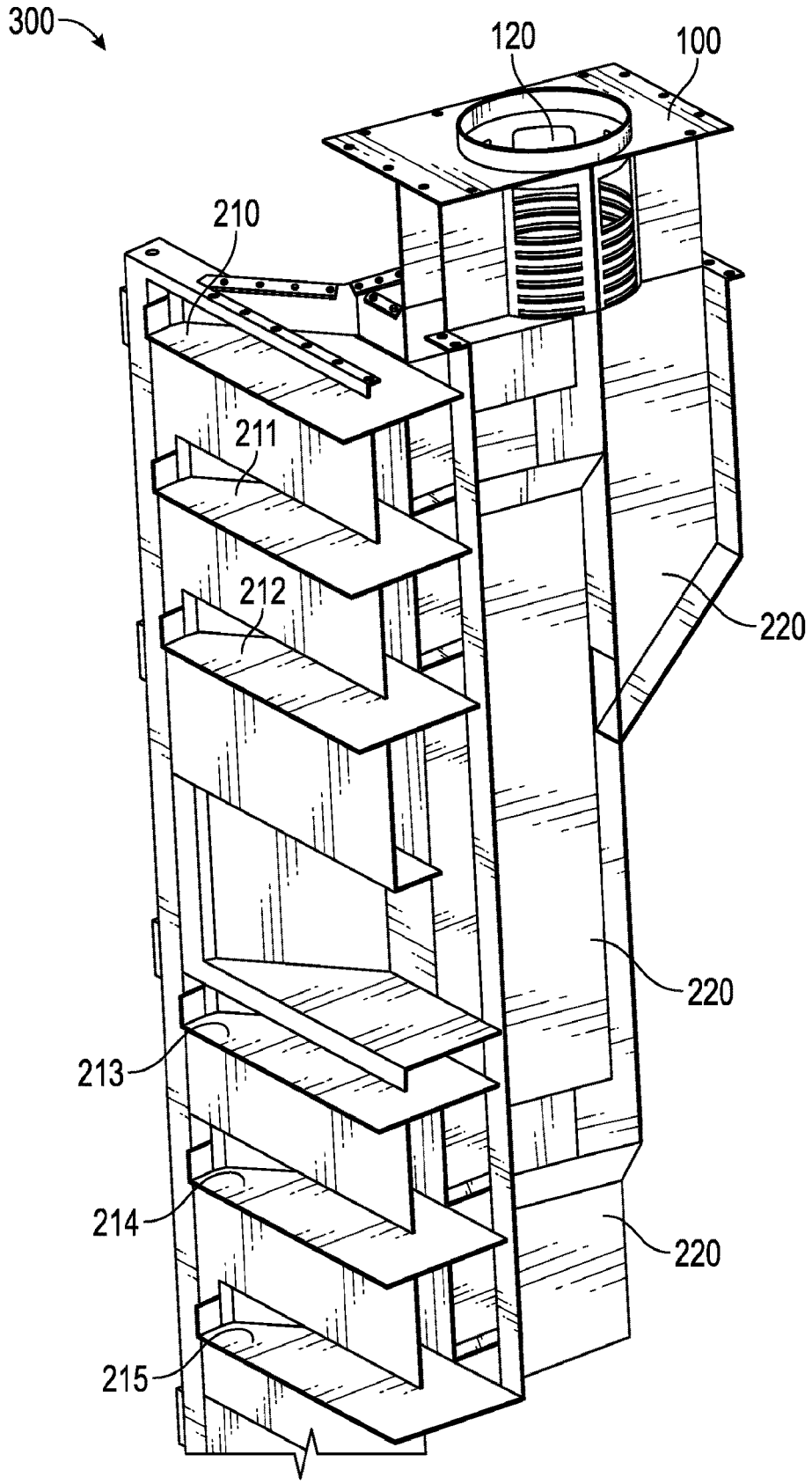
FIG. 3 shows a perspective cross-sectional view on an exemplary six-deck inlet door of a gyratory sifter with an exemplary splitter.

FIG. 3 is a perspective, cross-sectional view of the exemplary inlet door 200 of FIG. 2. The perspective sectional view of FIG. 3 helps to illustrate how inlets 220 couple the openings (having slits 120) of splitter 100 to the decks 210-215. In FIG. 3, the opening of splitter 100 corresponding to the top deck 210 is not associated with an inlet; rather, the input material may fall directly from the splitter opening to the top deck. Each of the other openings of splitter 100 corresponds to its own inlet 220, and each inlet 220 corresponds to its own deck. When a gyratory sifter is in operation, input material may be thrown from openings through slits 120, as previously described, such that approximately an equal amount of input material exits from each opening. In this manner, the input material may be distributed via inlets 220 to each deck 210-215 such that each deck 210-215 receives approximately an equal amount of input material.

Figure 4:
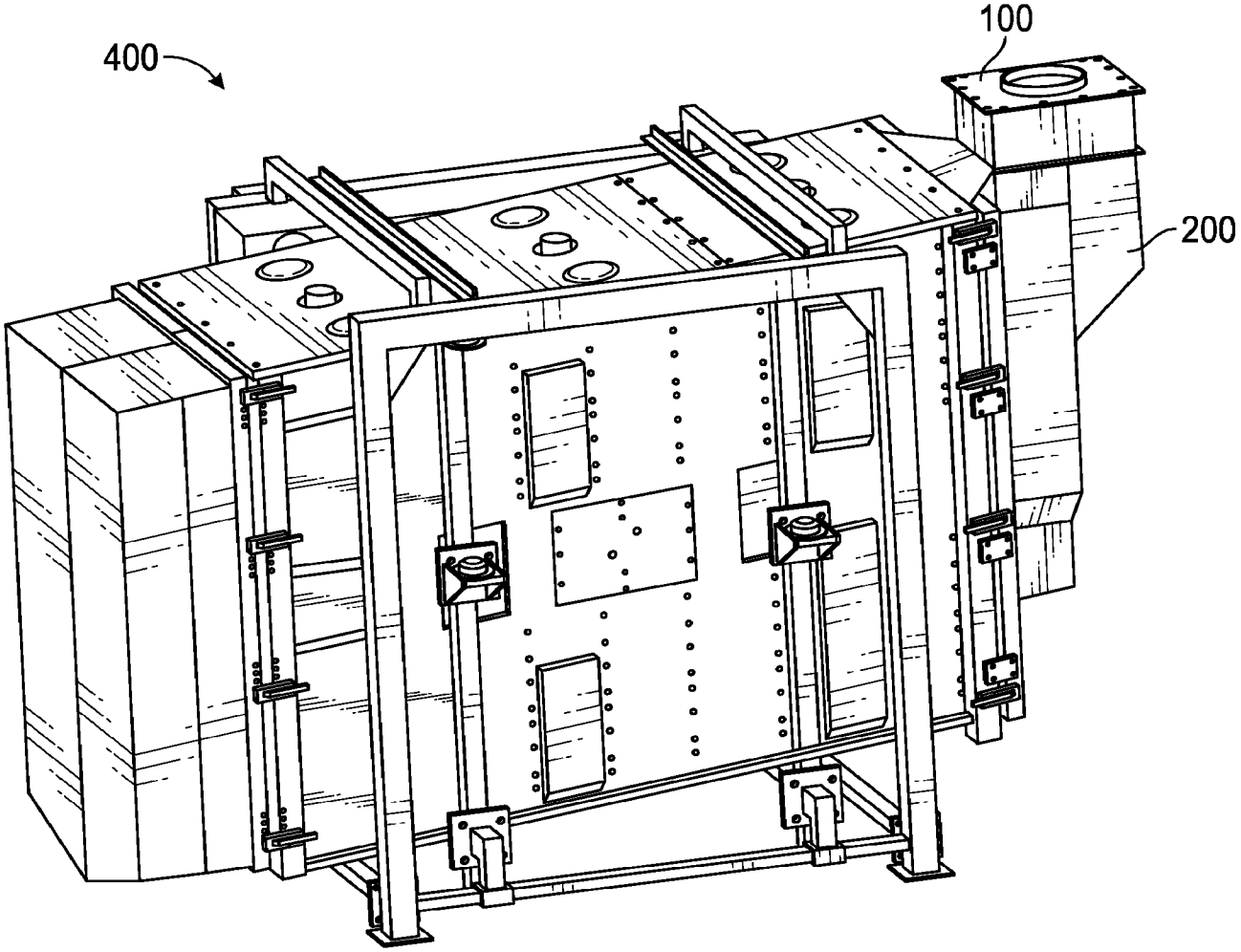
FIG. 4 shows a perspective view of an exemplary gyratory sifter with an exemplary splitter, each of which are in accordance with at least one embodiment of the present disclosure.

FIG. 4 is a perspective view of an exemplary gyratory sifter 400 with a splitter 100 installed above an exemplary input door 200.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. A splitter for a gyratory sifter, comprising:

a top surface defining an inlet configured to receive material fed to the splitter;

a bottom surface opposing the top surface and being solid in form such that any of the material flow fed to the splitter is prevented from exiting a bottom of the splitter; and a cylindrical sidewall coupled to the top surface and the bottom surface and perpendicularly extending away from the bottom surface and the top surface, the cylindrical sidewall and the bottom surface defining a reservoir coaxial with the inlet and configured to retain at least a portion of the material flow fed to the splitter;

wherein the cylindrical sidewall includes one or more openings, each opening corresponding to a deck on a gyratory sifter.

2. The splitter of claim 1, wherein the cylindrical sidewall includes six openings of equal area.

3. The splitter of claim 1, wherein each opening of the one or more openings comprises a plurality of slits which permit a flow of the material flow therethrough.

4. The splitter of claim 1, wherein each opening of the one or more openings comprises at least one overflow window which permits a flow of the material flow therethrough.

5. The splitter of claim 1, wherein the cylindrical sidewall includes a reservoir-facing surface and an exterior-facing surface; and further comprising dividers coupled to the exterior facing surface, each divider extending outwardly from the cylindrical sidewall, and each divider further extending from the top surface to the bottom surface.

6. The splitter of claim 5, wherein the number of dividers is one less than the number of decks in the gyratory sifter.

7. The splitter of claim 1, wherein each opening comprises:

a plurality of slits which permit a first flow of the material flow therethrough; and at least one overflow window which permits a second flow of the material flow therethrough, wherein the at least one overflow window and the plurality of slits are vertically aligned.

8. The splitter of claim 7, wherein each slit of the plurality of slits is smaller in size than the at least one overflow window.

9. A gyratory sifter, comprising:

a plurality of decks, each deck including one or more screens;

a splitter comprising:

a top surface defining an inlet configured to receive material fed to the gyratory sifter;

a bottom surface opposing the top surface and being solid in form such that any of the material flow fed to the splitter is prevented from exiting a bottom of the splitter; and a cylindrical sidewall including one or more openings, the cylindrical sidewall coupled to the top surface and the bottom surface and perpendicularly extending away from the bottom surface and the top surface, and the cylindrical sidewall and the bottom surface defining a reservoir coaxial with the inlet and configured to retain at least a portion of the material flow fed to the splitter; and an inlet door forming respective flowpaths from each opening to a corresponding deck of the plurality of decks.

10. The gyratory sifter of claim 9, wherein the cylindrical sidewall includes six openings of equal area.

11. The gyratory sifter of claim 9, wherein each opening of the one or more openings comprises a plurality of slits which permit a flow of the material flow therethrough.

12. The gyratory sifter of claim 9, wherein each opening of the one or more openings comprises at least one overflow window which permits a flow of the material flow therethrough.

13. The gyratory sifter of claim 9, wherein the cylindrical sidewall includes a reservoir-facing surface and an exterior-facing surface; and further comprising dividers coupled to the exterior facing surface, each divider extending outwardly from the cylindrical sidewall, and each divider further extending from the top surface to the bottom surface.

14. The gyratory sifter of claim 13, wherein the number of dividers is one less than the number of decks in the gyratory sifter.

15. The gyratory sifter of claim 9, wherein each opening comprises:

a plurality of slits which permit a first flow of the material flow therethrough; and at least one overflow window which permits a second flow of the material flow therethrough, wherein the at least one overflow window and the plurality of slits are vertically aligned.

16. The gyratory sifter of claim 15, wherein each slit of the plurality of slits is smaller in size than the at least one overflow window.

17. The gyratory sifter of claim 9, wherein the splitter is fixedly attached to the inlet door.

18. A gyratory sifter, comprising:

a plurality of decks, each deck including one or more screens;

a splitter comprising:

a top surface defining an inlet configured to receive material fed to the gyratory sifter;

a bottom surface opposing the top surface and being solid in form such that any of the material flow fed to the splitter is prevented from exiting a bottom of the splitter; and a sidewall including one or more openings, the sidewall coupled to the top surface and the bottom surface and perpendicularly extending away from the bottom surface and the top surface, and the sidewall and the bottom surface defining a reservoir coaxial with the inlet and configured to retain at least a portion of the material flow fed to the splitter; and an inlet door forming respective flowpaths from each opening to a corresponding deck of the plurality of decks, wherein each opening of the one or more openings comprises:

a plurality of slits which permit a first flow of the material flow therethrough; and at least one overflow window which permits a second flow of the material flow therethrough, wherein the at least one overflow window and the plurality of slits are vertically aligned, and wherein each slit of the plurality of slits is smaller in size than the at least one overflow window.

19. The gyratory sifter of claim 18, wherein the sidewall includes a reservoir-facing surface and an exterior-facing surface; and further comprising dividers coupled to the exterior facing surface, each divider extending outwardly from the sidewall, and each divider further extending from the top surface to the bottom surface.

20. The gyratory sifter of claim 19, wherein the number of dividers is one less than the number of decks in the gyratory sifter.

* * * * *